US012534960B2

(12) United States Patent
Jamieson

(10) Patent No.: US 12,534,960 B2
(45) Date of Patent: Jan. 27, 2026

(54) SYSTEMS AND METHODS FOR DELIVERY OF GOODS

(71) Applicant: Helmerich & Payne Technologies, LLC, Tulsa, OK (US)

(72) Inventor: Angus Lamberton Jamieson, Inverness (GB)

(73) Assignee: Helmerich & Payne Technologies, LLC, Tulsa, OK (US)

( * ) Notice: Subject to any disclaimer, the term of this patent is extended or adjusted under 35 U.S.C. 154(b) by 0 days.

(21) Appl. No.: 18/626,837

(22) Filed: Apr. 4, 2024

(65) Prior Publication Data

US 2024/0344401 A1 Oct. 17, 2024

Related U.S. Application Data

(60) Provisional application No. 63/494,126, filed on Apr. 4, 2023.

(51) Int. Cl.
*E21B 7/10* (2006.01)
*E21B 7/20* (2006.01)

(52) U.S. Cl.
CPC . *E21B 7/10* (2013.01); *E21B 7/20* (2013.01)

(58) Field of Classification Search
CPC ... E21B 10/26; E21B 7/06; E21B 7/28; E21B 7/046; E21B 7/20; E21B 7/10
See application file for complete search history.

(56) References Cited

U.S. PATENT DOCUMENTS

| | | | | |
|---|---|---|---|---|
| 4,519,463 | A * | 5/1985 | Schuh | E21B 43/305 166/50 |
| 4,828,050 | A * | 5/1989 | Hashimoto | E21B 7/20 175/45 |
| 2004/0188142 | A1* | 9/2004 | Self | E21B 7/06 175/406 |
| 2016/0236871 | A1* | 8/2016 | Bonino | B61B 13/10 |
| 2018/0209928 | A1* | 7/2018 | Li | E21B 47/007 |
| 2019/0211628 | A1* | 7/2019 | Halderman | E21B 7/20 |
| 2019/0330957 | A1* | 10/2019 | Robinson | E21B 43/086 |
| 2020/0018163 | A1* | 1/2020 | Jordaan | E21B 10/28 |
| 2020/0032598 | A1* | 1/2020 | Kysely | E21B 7/28 |
| 2023/0166775 | A1* | 6/2023 | Cooley | B61B 13/12 104/138.1 |

* cited by examiner

*Primary Examiner* — Kipp C Wallace
(74) *Attorney, Agent, or Firm* — Kilpatrick Townsend & Stockton LLP

(57) ABSTRACT

Provided are methods and systems for transportation of goods through a wellbore as well as systems for drilling such wellbores. Methods and systems include drilling a first wellbore with a first diameter. Methods and systems include determining an offset of the first wellbore from a desired position along at least a portion of the first wellbore's length. Methods and systems include drilling a second wellbore with a second diameter responsive to the determined offset, where drilling the second wellbore includes using a drill bit offset from a central axis of a bullnose by one or more actuators, where the second diameter is greater than the first diameter.

20 Claims, 9 Drawing Sheets

SYSTEMS AND METHODS FOR DELIVERY OF GOODS

CROSS REFERENCE TO RELATED APPLICATION

This application claims the benefit of U.S. Provisional Ser. No. 63/494,126 filed Apr. 4, 2023, and entitled SYSTEMS AND METHODS FOR DELIVERY OF GOODS. The entire disclosure of this application is incorporated by reference in its entirety for all purposes.

FIELD OF THE DISCLOSURE

The present disclosure relates generally to systems and methods for drilling of wellbores. More particularly, to systems and methods for drilling wellbores.

BACKGROUND

The proliferation of commercial delivery services in cities results in more vehicular traffic and thus ever more traffic congestion and vehicle emissions. Cutting down on the need for the use of trucks, vans, and cars to deliver goods to and throughout a city would reduce traffic congestion and emissions. Attempts to deliver goods from outside the radius of the city have included subterranean delivery. However, previous attempts have failed to provide pathways for quick and efficient delivery of goods. Namely, existing wellbores do not exhibit sufficient smoothness and straightness to consistently and accurately provide goods autonomously through drilled wellbores.

SUMMARY OF THE DISCLOSURE

The present technology is generally directed to methods of delivery packages through a wellbore, and methods of drilling wellbores for transportation of goods. Methods include drilling a first wellbore with a first diameter. Methods include determining an offset of the first wellbore from a desired position along at least a portion of a length of the first wellbore. Methods include drilling a second wellbore with a second diameter correcting the determined offset, where drilling the second wellbore includes a drill bit having a bullnose central axis that is freely movable by one or more actuators within a blade central shaft, and where the second diameter is greater than the first diameter.

In embodiments, methods include casing an interior facing portion of an external surface of the second wellbore. Furthermore, in embodiments, methods include coating an interior surface of the casing with a low friction material. In more embodiments, the first wellbore and the second wellbore extend from a first location to a second location, where the second location is within an urban area. Additionally or alternatively, in embodiment, the second wellbore extends from the first location to a plurality of locations, wherein at least one of the plurality of locations is within the urban area. In embodiments, methods include drilling a third wellbore extending from a position along the second wellbore to a third location, wherein the third location is remote from both the first location and the second location. In yet more embodiments, methods include surveying at least a portion of the first wellbore, responsive to the survey of the first wellbore, determining a plurality of offset values from a desired trajectory of the first wellbore, where each of the plurality of offset values corresponds to one of a plurality of depths and/or distances along the first wellbore, and responsive to the plurality of offset values, activating the one or more actuators to control an amount by which the drill bit is offset from the central axis of the bullnose during drilling of the second wellbore. In embodiments, the first wellbore includes a trajectory adapted to provide a pathway with an optimized geometry balancing the length of the wellbore with the lateral and axial acceleration forces experienced at each point along the pathway. Moreover, in embodiments, the second wellbore includes a trajectory adapted to provide a pathway with an optimized geometry balancing the length of the wellbore with the lateral and axial acceleration forces experienced at each point along the path.

The present technology is also generally directed to systems for delivering one or more goods. Systems include a wellbore extending from a first location to a second location, where the second location is located in an urban area and the first location is remote from the second location, and the wellbore includes an interior facing surface having a low coefficient of friction. Systems include an above ground access point, providing access to the wellbore at the first location. Systems include a movement system for moving the one or more goods through the wellbore from the first location to the second location. Systems include a second above ground access point at the second location, providing access to the wellbore at the second location for receiving the one or more goods at the second location.

In embodiments, the movement system includes pneumatic pressure. Moreover, in embodiments, one or more of the one or more goods is located in a casing, where the casing has one or more low friction pads. In further embodiments, one or more of the one or more goods is located in a casing, where the casing includes one or more wheels. Additionally or alternatively, in embodiments, the casing further includes an identifier. In yet more embodiments, the identifier includes an identification of a source of the goods or a recipient of the goods. Embodiments include the wellbore includes a second wellbore extending from a branch or junction location along the wellbore between the first and second locations to a third location, where the third location is remote from the first location and the second location. In embodiments, at least one of the goods is located in a package and the package includes an identifier, wherein the identifier indicates whether the package is to be delivered to the second location or the third location. In further embodiments, systems include a scanner or reader located in the wellbore for reading an identifier and determining a destination of the one or more goods. Embodiments include a control for directing the one or more goods to the third location responsive to a reading of the identifier indicating that the third location is the destination of the one or more goods.

Reference to the remaining portions of the specification, including the drawings and claims, will realize other features and advantages of embodiments of the present disclosure. Further features and advantages, as well as the structure and operation of various embodiments of the present disclosure, are described in detail below with respect to the accompanying drawings. In the drawings, like reference numbers can indicate identical or functionally similar elements.

DETAILED DESCRIPTION

Figure 1:
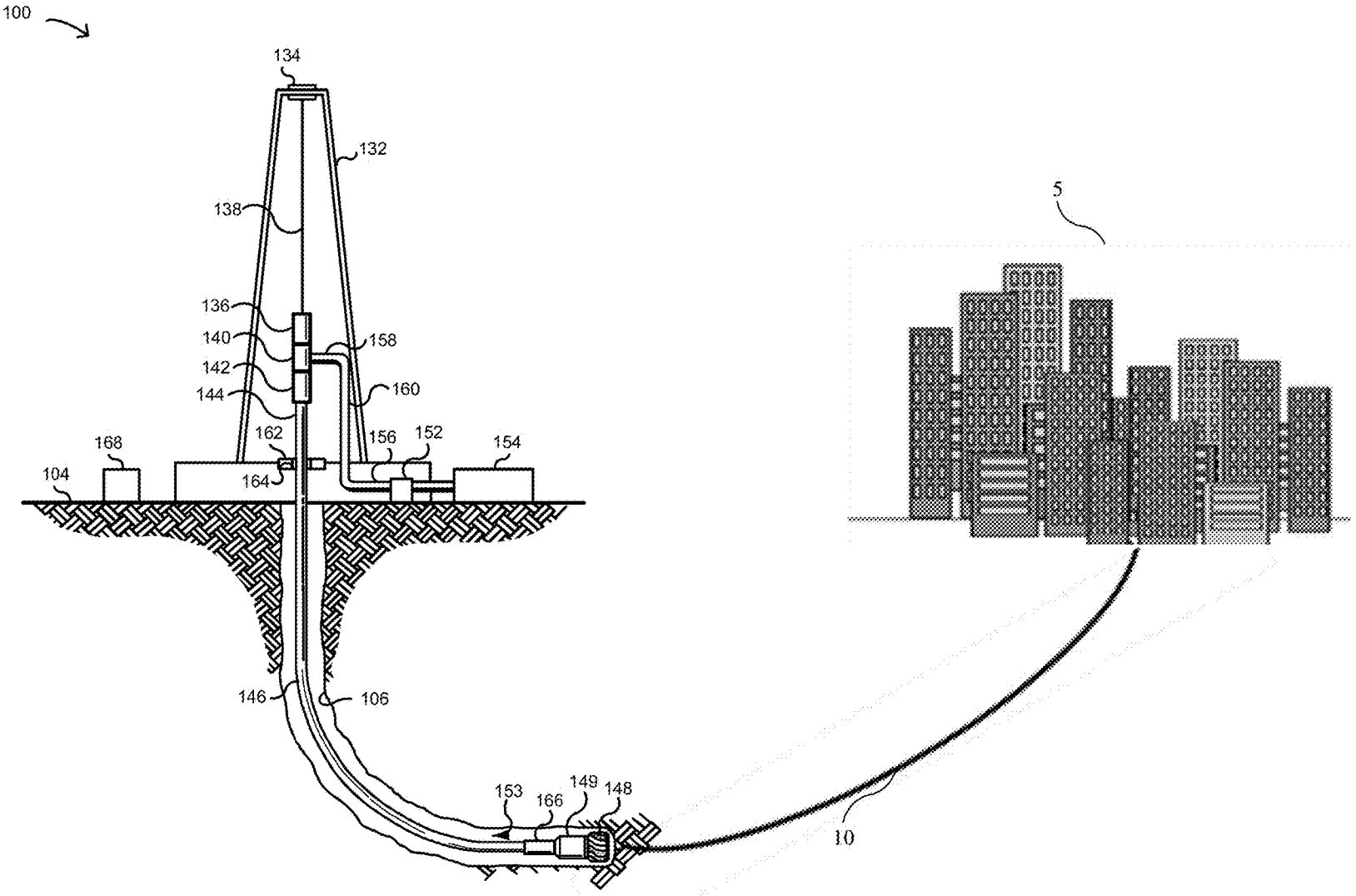
FIG. 1 illustrates a schematic diagram is shown of a drilling rig according to embodiments of the present technology.

In the following description, details are set forth by way of example to facilitate discussion of the disclosed subject matter. It should be apparent to a person of ordinary skill in the field, however, that the disclosed embodiments are exemplary and not exhaustive of all possible embodiments.

The following disclosure addresses problems associated by dense traffic, traffic congestion, and traffic emissions from delivery of goods, by providing systems and methods for delivering goods. In embodiments, a wellbore is drilled from outside an urban center to a location inside the city. Namely, the present technology has found that by utilizing the methods discussed herein, the well can be drilled in a manner so that the wellbore is relatively smooth and has a high degree of adherence to a proposed drill path. By controlling the shape, size, and smoothness of the wellbore, a wellbore or tube can be created that extends from outside an urban area to a location within the urban area. The tube can be used for the autonomous delivery of goods, such as by providing a flow of air to move packages containing the goods through the tube or wellbore.

It should be noted that "urban" and "rural" may have various meanings. For example, after the 2010 Census, the United States Census Bureau adopted a definition of "urban" as including an area with a total population of 50,000 or an urban cluster of between 2,500 and 50,000 people. These areas were determined by using a population density of 1,000 people per square mile to delineate an urban core and then 500 people per square mile to finish the delineation as one moves outward from the urban core through suburbs. After the 2020 Census, the United States Census Bureau uses housing density of 2,000 housing units to define an area as urban. For purposes of this application, "urban" should be taken to mean a city or town with a total population of at least 50,000 people and a population density of at least 1,000 people per square mile.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

The systems and methods used to drill oil and gas wells are complex and sophisticated. Methods and systems developed for oil and gas wells can be adapted for use in planning, drilling, and creating wells for geothermal energy. The following discussion provides a description of systems and techniques for drilling wells that can be useful for drilling geothermal wells, as well as generating electricity therefrom.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture (e.g., drilling mud 153) from a mud pit 154 into drill string 146. Mud pit 154 is shown schematically as a container, but it is noted that various receptacles, tanks, pits, or other containers may be used. Drilling mud 153 may flow from mud pump 152 into a discharge line 156 that is coupled to a rotary hose 158 by a standpipe 160. Rotary hose 158 may then be coupled to top drive 140, which includes a passage for drilling mud 153 to flow into borehole 106 via drill string 146 from where drilling mud 153 may emerge at drill bit 148. Drilling mud 153 may lubricate drill bit 148 during drilling and, due to the pressure supplied by mud pump 152, drilling mud 153 may return via borehole 106 to surface 104.

Figure 4:
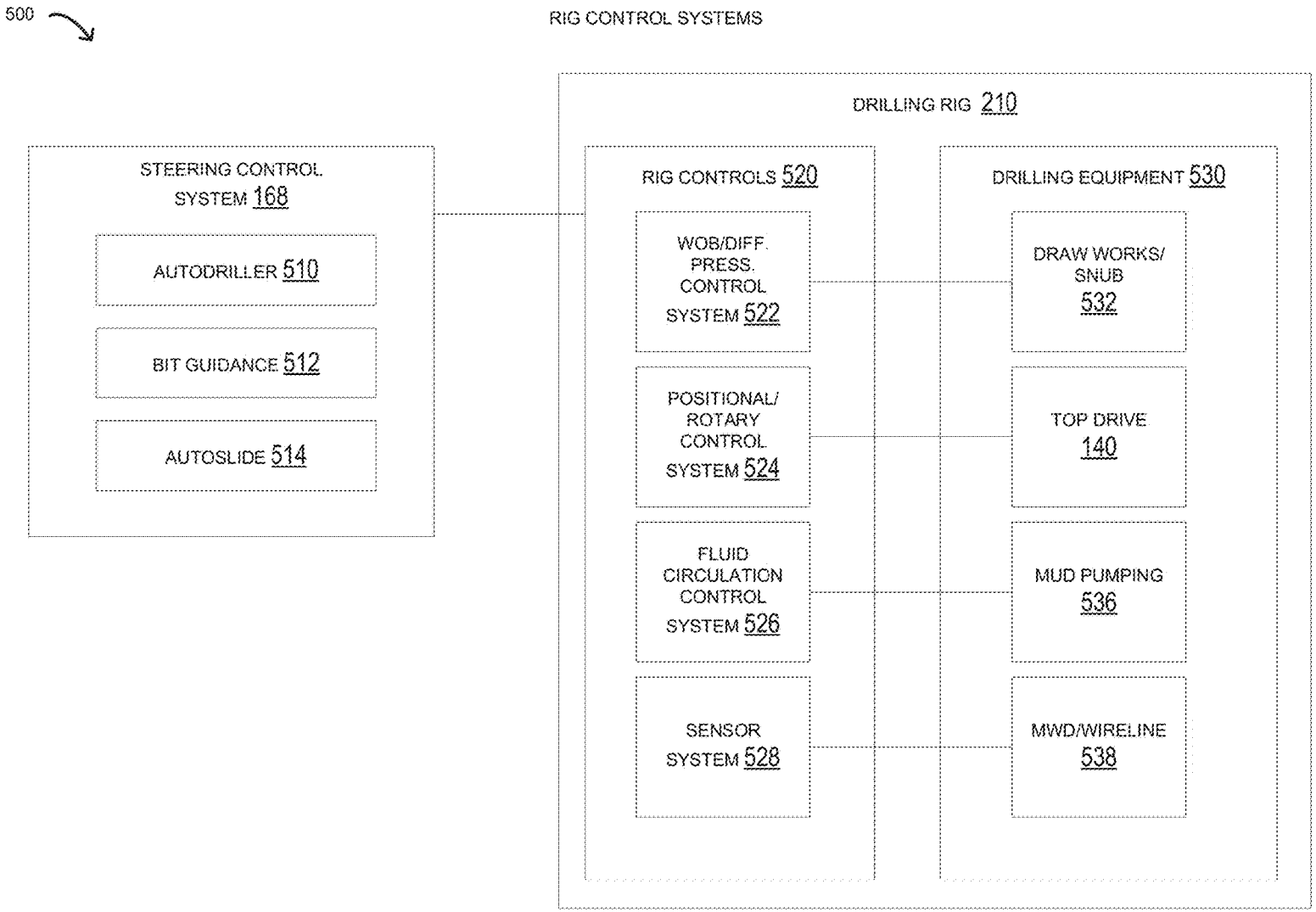
FIG. 4 illustrates a depiction of rig control systems included in the drilling system.

In drilling system 100, drilling equipment (see also FIG. 4) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 4. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, which may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD (measure while drilling) tool or a LWD (logging while drilling) tool or both, and may accordingly utilize connectivity to the surface 104, local storage, or both. In different implementations, gamma radiation sensors, magnetometers, accelerometers, inertial sensors, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106. For example, steering control system 168 may be a stand-alone system or may be incorporated into other systems included with drilling system 100.

In operation, steering control system 168 may be accessible via a communication network (see also FIG. 4) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using certain methods and systems for improved drilling performance.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein using the downhole surveys and other information referenced herein.

Figure 2:
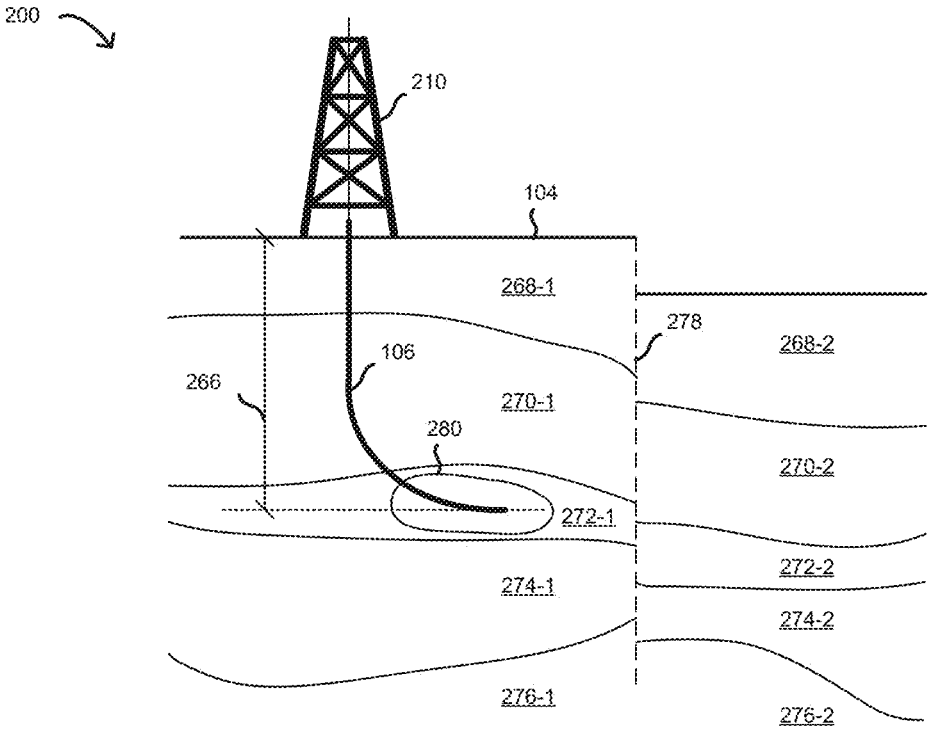
FIG. 2 illustrates a depiction of a drilling environment including the drilling system for drilling a borehole.
Figure 3:
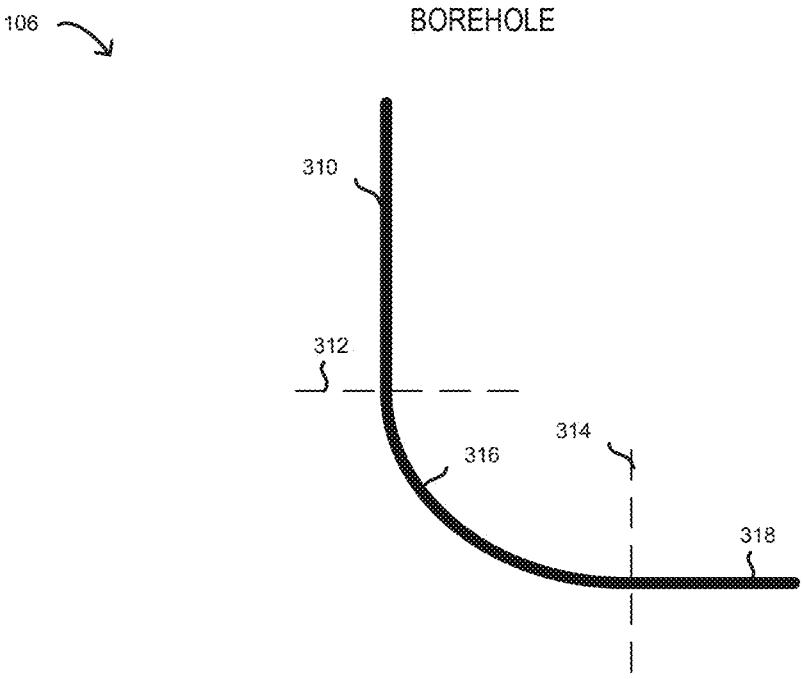
FIG. 3 illustrates a depiction of a borehole generated in the drilling environment.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

Figure 5:
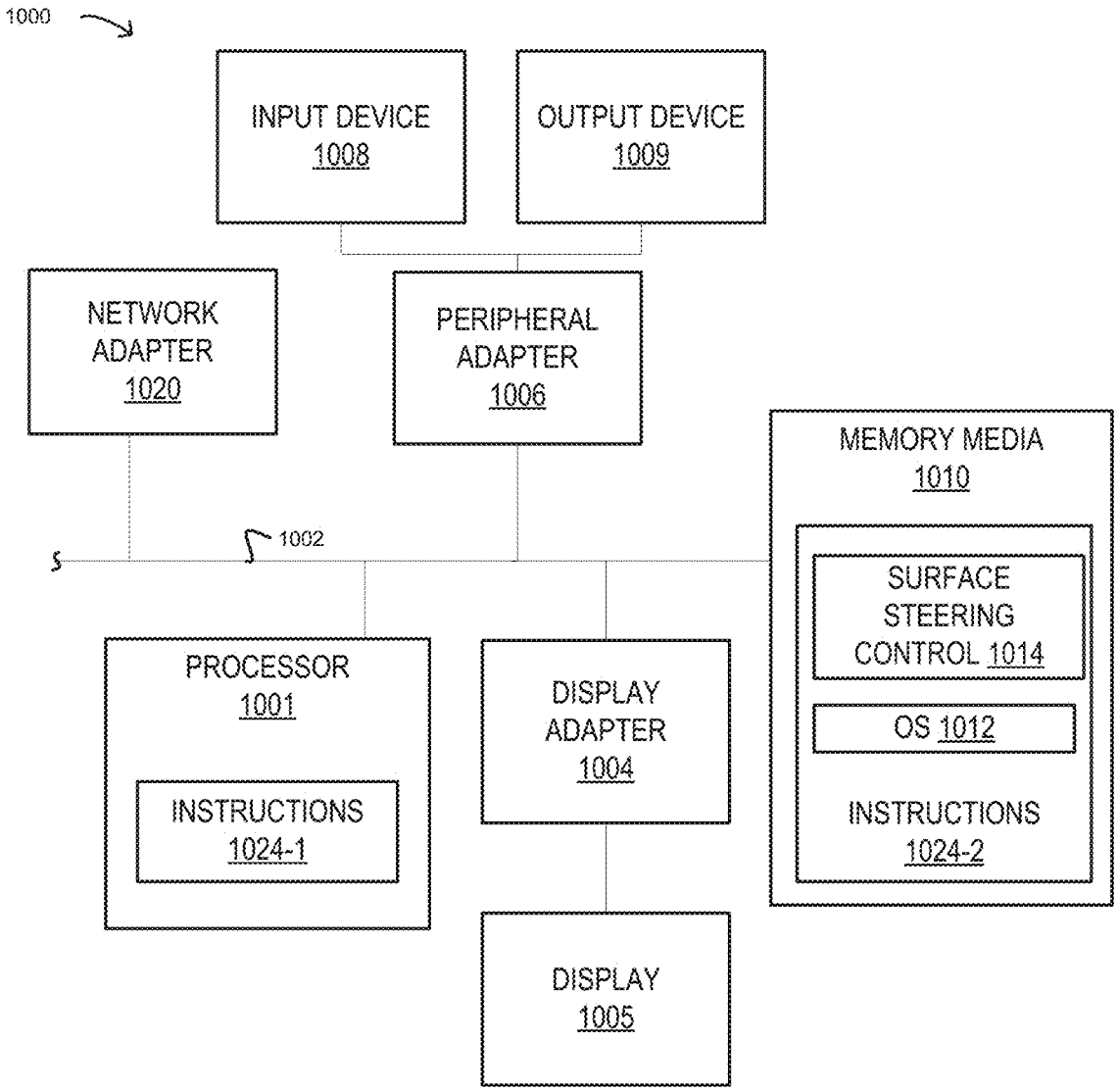
FIG. 5 illustrates a depiction of a controller usable by the rig control systems.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database. At drilling system 100, the collected data may be stored at the surface 104 or downhole in drill string 146, such as in a memory device included with BHA 149 (see also FIG. 5). Alternatively, at least a portion of the collected data may be stored on a removable storage medium, such as using steering control system 168 or BHA 149, which is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIG. 4). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 4). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device, to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a drill plan, a regional formation history, drilling engineer parameters, downhole toolface/inclination information, downhole tool gamma/resistivity information, economic parameters, and reliability parameters, among various other parameters. Some of the input information, such as the regional formation history, may be available from a drilling hub 410, which may have respective access to a regional drilling database (DB). Other input information may be accessed or uploaded from other sources to steering control system 168. For example, a web interface may be used to interact directly with steering control system 168 to upload the drill plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 4). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168.

While the above description generally discusses drilling systems and methods of drilling, the present technology also provides systems and methods where the drilling rig 100 is located on a surface 104 at a location that is remote from an urban area 5. Connecting the drilling system 100 and the urban area 5 may be a wellbore 10. In embodiments, after drilling, the wellbore 10, an access point may be defined at or above the surface 104 (e.g. above ground), giving above ground access to the wellbore 10, and may therefore also provide access to the wellbore for providing one or more packages into the wellbore. Furthermore, one or more second access points may be provided on or above the surface 104 (e.g. above ground) at the urban area 5 for receiving one or more packages.

In embodiments, a drilling rig 100 with high accuracy navigation systems is used to drill a smooth wellbore from outside the city 5 into a hub point in the city 5. In embodiments, the hub point could be proximal a geographic center of the city 5 or the hub point could be located on the outskirts of the city 5. In embodiments, the first location outside the city may be up to 10 miles, or about 14 kilometers, from the second location in the city, such as up to or about 9 miles, up to or about 8 miles, up to or about 7 miles, up to our about 6 miles, up to or about 5 miles, up to or about 4 miles, up to or about 3 miles, up to or about 2 miles, about 1 mile or less, or any ranges or values therebetween. If, over time, the city expands, the hub point may be moved from a first location along the wellbore to a second location, which may be closer or further from the drilling rig 1. If the wellbore is smooth enough, it is believed that goods can be pumped through at high speeds without lateral vibration and in a very cost-effective manner, especially when considered versus the costs of vehicular traffic to deliver the same amount of goods.

Drilling a wellbore that is smooth enough (e.g. low friction interior facing surface and/or low tortuosity index) for efficiently delivering goods over distances has proven to be a difficult and challenging task, as discussed above. However, it is believed that the systems and methods described herein can be used to drill such a wellbore and achieve the goals and objectives stated.

In embodiments, a smaller gauge pilot borehole (such as 902 discussed in greater detail below in regards to FIG. 9) having one or more diameters is drilled. As examples only, as the pilot borehole may have any diameter less than a diameter of the full-sized bore hole, the pilot borehole may have a diameter that ranges from about 1 inch to about 24 inches, about 2 inches to about 22 inches, about 3 inches to about 20 inches, about 4 inches to about 18 inches, about 5 inches to about 16 inches, about 6 inches to about 14 inches, about 7 inches to about 12 inches, about 8 inches to about 10 inches, or such as about 8 inches in diameter, or any ranges or values therebetween.

However, in embodiments, the pilot borehole may have any diameter less than the full-sized borehole (such as 904 discussed in greater detail below in regards to FIG. 9), such greater than or about 2% less than a diameter of a fill-sized borehole, greater than or about 5%, greater than or about 10%, greater than or about 15%, greater than or about 20%, greater than or about 25%, greater than or about 30%, greater than or about 35%, greater than or about 40%, greater than or about 45%, greater than or about 50%, greater than or about 55%, greater than or about 60%, greater than or about 65%, greater than or about 70%, greater than or about 75%, greater than or about 80%, greater than or about 85%, greater than or about 90% less than the full-sized borehole diameter, or any ranges or values therebetween.

During drilling, after drilling, or both during and after drilling, the pilot borehole is surveyed, according to any one or more of the survey methods and sensors discussed above, as well as others as known in the art. In embodiments, the survey may gather coordinates, inclination data, direction data, or a combination thereof, at various intervals along the pilot borehole depth (e.g. length of wire into the borehole). In embodiments, the survey may occur from about every inch to about every 20 feet, such as less than or about 19 feet, less than or about 18 feet, less than or about 17 feet, less than or about 16 feet, less than or about 15 feet, less than or about 14 feet, less than or about 13 feet, less than or about 12 feet, less than or about 11 feet, less than or about 10 feet, less than or about 9 feet, less than or about 8 feet, less than or about 7 feet, less than or about 6 feet, less than or about 5 feet, less than or about 4 feet, less than or about 3 feet, less than or about 2 feet, less than or about every foot, less than or about every 6 inches, less than or about ever 4 inches, less than or about every 2 inches, or any ranges or values therebetween. Additionally or alternatively, in embodiments, the survey may be generally continuous along the pilot borehole, and may therefore record data for most, if not all, depths along the pilot borehole. In embodiments, the survey may occur during drilling the pilot borehole, after drilling the pilot borehole, or both. In survey occurs both during and after drilling the pilot borehole, different depth measurement locations or the same depth measurement locations may be utilized.

Figure 6:
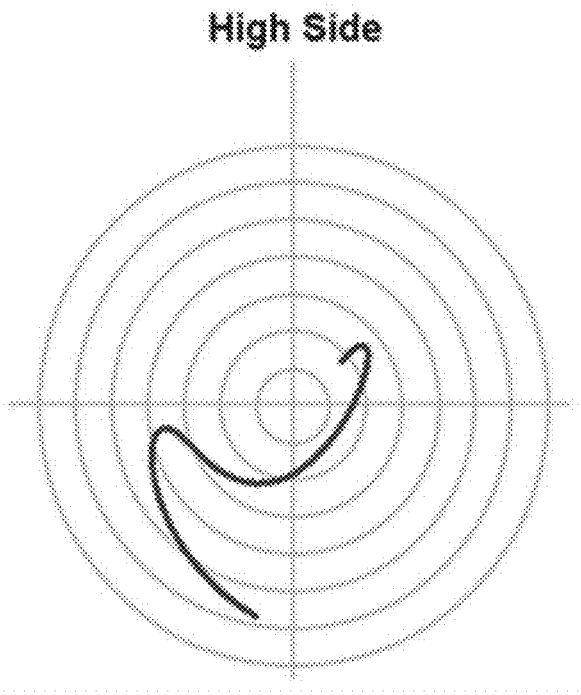
FIG. 6 illustrates an example of "wander" from an as drilled position to the centre of an ideal wellbore path, according to embodiments of the present technology.

From the survey of the pilot borehole, the offset from a desired trajectory at one or more depths, lateral distances, or a combination thereof, along the pilot borehole can be derived. For instance, in embodiments, the ideal or planned wellbore path may be plotted as a series of locations at various depths (e.g. each depth surveyed as discussed above), and a curve may be fitted to the series of locations. The smooth curve may then be compared to the survey data collected (e.g., to the coordinates, inclination data, direction data, or a combination thereof) at the one or more depths, resulting in offset data (e.g. an "as drilled offset"), showing the difference from the planned location to the surveyed location, at the one or more depths. The as drilled offset may be represented as a new series of coordinates or other location data as discussed herein at the one or more depths, that may be utilized to plan a new drill path for the full-sized borehole, which will be discussed in greater detail below. The as drilled offset from the desired trajectory can therefore be calculated as a series of polar coordinates of 'wander' along the path of the borehole, which is illustrated in FIG. 6. In FIG. 6, the depicted path is an illustration of collected position points that show the 'wander' vector in reverse. That is, FIG. 6 illustrates the "wander" from the center point (or longitudinal axis) of the as-drilled position of the pilot borehole to the center (or longitudinal axis) of the ideal or planned wellbore path. As discussed, based upon the coordinates measured, a matrix of new coordinates or location data can be generated that includes the offset values along the wellbore path with their corresponding measured depth or distance values (e.g. at each point or at a set distance along the as-drilled pilot borehole). In embodiments, the survey of the as drilled pilot borehole can be used to generate a desired trajectory of the full sized borehole, alone or in combination with the above matrix. For example, a trajectory that smooths out the curvature of a centerline of the as drilled borehole as determined by the survey of the as drilled pilot borehole can be generated. In such an approach, the original planned trajectory of the borehole may be used in generating the desired trajectory. Once the desired trajectory is determined, the offset of the as drilled borehole may be determined alone or in addition to the desired trajectory as described above.

After determination of the offset, a full-sized borehole (such as 904 discussed in greater detail below in regards to FIG. 9) can be drilled using one or more hole opening techniques or operations, such as by expanding the diameter of the pilot borehole. In exemplary embodiments, as other diameters are contemplated herein, the full-sized borehole may have one or more diameters ranging from about 8 inches to about 120 inches, about 10 inches to about 100 inches, about 12 inches to about 80 inches, about 14 inches to about 60 inches, about 16 inches to about 50 inches, about 18 inches to about 48 inches, about 20 inches to about 46 inches, about 22 inches to about 44 inches, about 34 inches to about 42 inches, about 26 inches to about 40 inches, about 28 inches to about 38 inches or such as about 36 inches in diameter, or any ranges or values therebetween.

For instance, in embodiments, an intelligent hole opener may be utilized that has a bit size selected according to the desired full-sized borehole diameter, such as any one or more of the diameters discussed above. Thus, as an example only, a drill bit (such as drill bit 700 illustrated in FIG. 7) having one or more blades (such as blades 706 illustrated in FIG. 7) guided by an appropriately sized bullnose (such as bullnose 708 illustrated in FIG. 8), in embodiments. In embodiments, the bullnose may have a smaller diameter than the blade diameter, so as to help guide or steer the drill bit. However, it should be clear that other drill bit and/or bullnose sizes may be selected in order to achieve any one or more of the diameters discussed above. Furthermore, it should be understood that other drill bit orientations are contemplated herein. Nonetheless, the hole-opening operation may utilize the offset matrix in order to expand the pilot hole, while also increasing the degree of conformance to the target longitudinal center line, as will be discussed in greater detail below in regards to FIG. 9.

Figure 7:
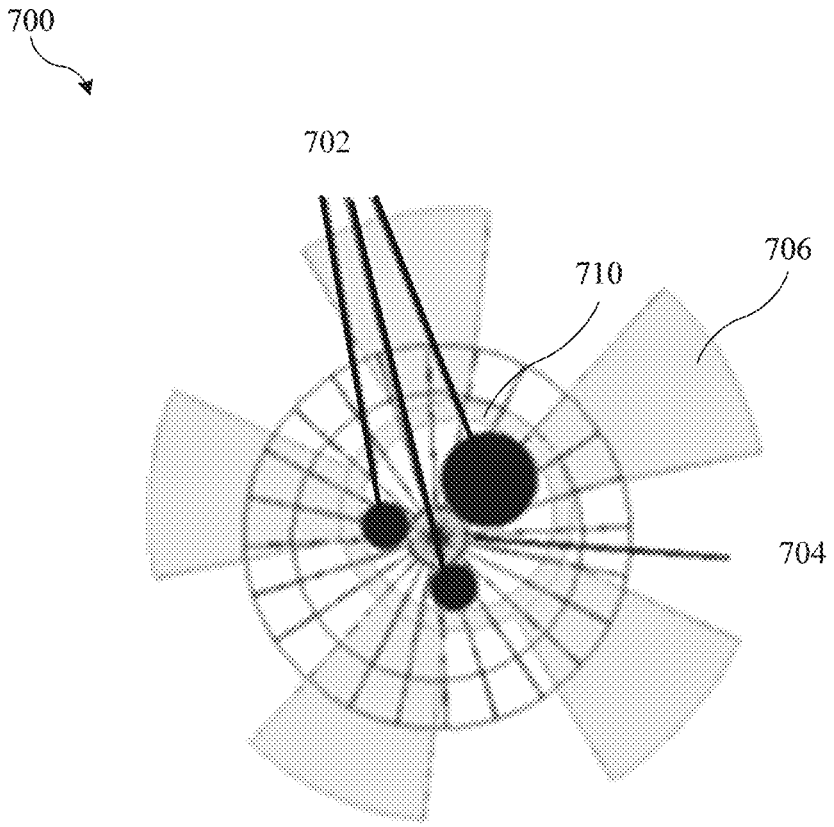
FIG. 7 illustrates a cross-sectional view of a drill bit having three actuators located, according to embodiments of the present technology.

FIG. 7 is a cross-sectional view that shows a drill bit having one or more actuators 702 located in a central blade shaft 710 of the drill bit 700. The one or more actuators 702 are of a shape, size and/or location to keep the bullnose shaft 704 a desired location relative to the drill bit. While the figure illustrates three actuators of varying sizes, it should be clear that more or less actuators may be utilized, and that the actuators may have the same size or different sizes. Nonetheless, as illustrated, the actuators work together to maintain the bullnose shaft 704 at a location corresponding to the drill offset calculated above. Namely, the actuators may be utilized to shift the location of the bullnose shaft to correct the location of the center point of the full-sized borehole based upon the drill offset calculated for the pilot borehole. For instance, as illustrated in FIG. 7, the actuators 702 may serve to offset the longitudinal axis of the blade shaft 710 from the bullnose shaft 704 longitudinal axis, and therefore offset the center point (e.g. longitudinal axis) of the blades 706 from the longitudinal axis of the bullnose shaft 704, which will be discussed in greater detail in regards to FIG. 9.

There are various types of actuators that can be used to offset the center of the rotating drill bit blades from the central shaft of the bullnose. Exemplary actuators may include one or more of hydraulic bladders, cone rams, pistons, or may be any other electronically controlled offset mechanism, combinations thereof, and the like. Furthermore, other actuators as known in the art may be utilized such that the bullnose central shaft may be provided in a desired location, which may be offset from a longitudinal axis of the blade shaft.

Thus, in embodiments, the full-sized borehole according to the present technology may have a high degree of adherence to the target path, by utilizing the methods discussed herein. For instance, the full-sized borehole may have a center point location (e.g. midpoint of the borehole diameter or longitudinal axis), that varies by less than or about 20% from a planned borehole center point (or longitudinal axis) when measured in inches at the one or more depths, such as less than or about 18%, less than or about 16%, less than or about 14%, less than or about 12%, less than or about 10%, less than or about 9%, less than or about 8%, less than or about 7%, less than or about 6%, less than or about 5%, less than or about 4%, less than or about 3%, less than or about 2%, less than or about 1%, or any ranges or values therebetween, at one or more depths, or at each depth, in embodiments.

Figure 8:
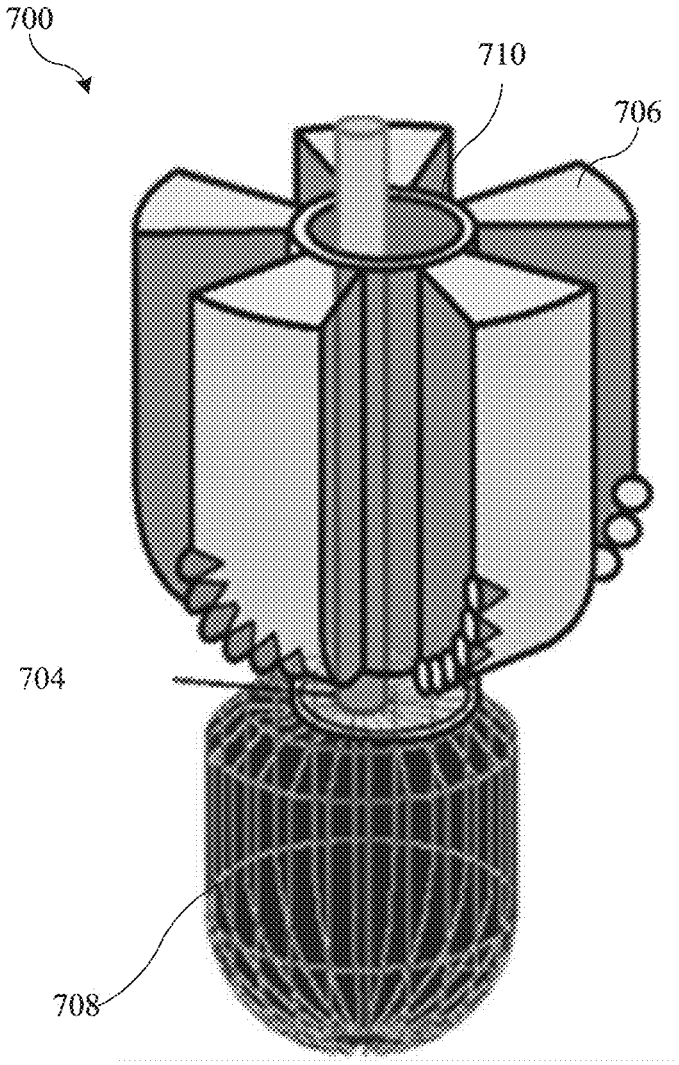
FIG. 8 illustrates an isometric view of a drill bit and bullnose, according to embodiments of the present technology.

Referring now to FIG. 8, an isometric view of the drill bit 700 having one or more blades 706, a bullnose shaft 704, and a bullnose 708 is shown. As shown in FIG. 8, the drill bit has a plurality of blades 706 extending radially outwardly from a longitudinal axis through an approximate center point of blade shaft 710 (e.g. extending through the shaft in a direction generally along the direction to be drilled). Although the actuators located within the central blade shaft are not shown in FIG. 8, it can be seen that the bullnose shaft 704 extends through the central blade shaft 710 of the drill bit 700. As shown in FIG. 8, the bullnose shaft 704, which is aligned with a center point of the bullnose (e.g. a point at an approximate center point of the bullnose shaft or a center point of the bullnose where an external circumference of the bullnose is located radially outward from the bullnose or bullnose shaft center point), may have its location varied by the one or more actuators, based upon the calculated drill offset. Thus, in examples, the bullnose shaft 704 may be located off-center (e.g. not co-axial) from the longitudinal axis of the drill bit. However, it should be understood that, in embodiments, a longitudinal axis of the bullnose shaft 704 may be coaxial with a longitudinal axis of the blade shaft 710.

The location of the longitudinal axis of the bullnose shaft relative to the longitudinal axis of the blade shaft can be determined from the drill offset matrix discussed above, which indicates the extent to which the center of the pilot well varies from the desired location of the wellbore axis at any given spot along the length of the wellbore (usually in terms of measured distance, such as inches). Namely, as discussed above, the bullnose 708 may be utilized to steer the drill bit 700. Thus, the bullnose may be utilized to steer the drill bit back onto the planned or ideal wellbore, based upon the calculated offset, such as by using the one or more actuators to offset the bullnose shaft from the blade shaft.

Figure 9:
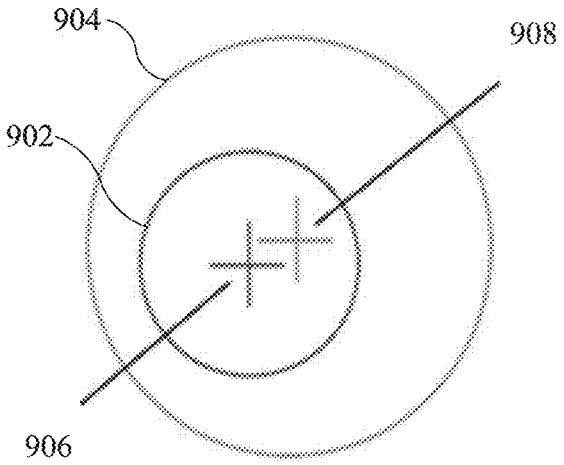
FIG. 9 illustrates a schematic diagram of an as drilled position and an ideal wellbore path, according to embodiments of the present technology.

Referring now to FIG. 9, an embodiment of the present technology is illustrated where one or more actuators are utilized to facilitate drilling a full-sized borehole 904 with a non-coaxial center point 908 to a center point 906 of a pilot borehole 902, such as, to account for a drill offset calculated after drilling of the pilot borehole 902. As indicated in FIG. 9, the full-sized borehole 904 may have a path corrected according to the calculated drill offset, resulting in a full-sized borehole 904 that has a longitudinal axis 908 (or center) at or nearer the target center point which may help to decrease or eliminate the wander exhibited after drilling of the pilot hole 902. Namely, in embodiments, the as drilled offset coordinates are utilized to prepare a well-plan for expanding the pilot borehole into a full-sized borehole. In such embodiments, the as drilled offset coordinates are utilized to determine the location of the bullnose shaft relative to the blade shaft, in order to correct the calculated wander. Namely, the bullnose path may be prepared to correct some or all of the calculated wander, setting a new longitudinal axis for the bullnose, in order to steer the drill bit, and forming a full-sized borehole at, or nearer to, the planned or ideal wellbore. In embodiments, this input may correspond to an amount of shift to the center point (or longitudinal axis) relative to an angle to the high side of the as-drilled borehole. However, other inputs are contemplated herein based upon the as drilled offset values.

As a result of this approach, a wellbore can be drilled that has a desired diameter, has a relatively smooth shape (e.g. a high adherence to a target path reducing sudden changes in path direction), and has a longitudinal axis located at or near a planned location along the length of the wellbore. For instance, the present technology may exhibit a high degree of adherence to a planned or ideal tortuosity index. The tortuosity index may provide insight into the amount of unplanned angles or turns in a wellbore. For instance, the tortuosity index may represent the degrees of curvature (e.g. unwanted curvature) divided by 90 degrees. In embodiments, the full-sized borehole according to the present technology may have a tortuosity index that is within about 20% of the planned or ideal path tortuosity index, such as varies from the planned or ideal path tortuosity index by less than or about 18%, less than or about 16%, less than or about 14%, less than or about 12%, less than or about 10%, less than or about 8%, less than or about 6%, less than or about 4%, less than or about 2%, less than or about 1%, or any ranges or values therebetween.

Once the full-sized borehole has been drilled (e.g. by expanding the pilot borehole), additional actions may be taken to further smooth the internal diameter (e.g. internal facing surface of the exterior walls) of the borehole. For example, the interior facing surface of the exterior walls or surface of the full-sized borehole may be lined with a casing material having a low degree of friction. Suitable materials may include steel, rigid plastics, the like, and combinations thereof. In embodiments, an interior surface of the casing material (including a steel casing) may also be further coated with a low friction coating. The low friction coating may decrease a kinetic friction coefficient of the casing material. For instance, in embodiments, such as casing or coating material may allow the tubes or pods containing goods to be accelerated or maintain speed more consistently through the full-sized wellbore. Namely, by reducing the coefficient of friction of the wellbore or casing material, frictional forces may be reduced such that the package or article is subjected to longitudinal acceleration and deceleration on a journey through the wellbore, with reduced action by friction. In addition, when placing the casing, the tortuosity index may be further improved. Namely, as the methods discussed herein allow for smoothing of tortuosity during expansion of the pilot borehole, the wander may be somewhat minimal after formation of the full-sized borehole. Thus, the rigid casing material may be able to further overcome any remaining excess tortuosity due to its rigid nature, and as any large variations were previously eliminated. Thus, the cased full-sized borehole according to the present technology may have a tortuosity index that is within about 20% of the planned or ideal path tortuosity index, such as varies from the planned or ideal path tortuosity index by less than or about 18%, less than or about 16%, less than or about 14%, less than or about 12%, less than or about 10%, less than or about 8%, less than or about 6%, less than or about 4%, less than or about 2%, less than or about 1%, or any ranges or values therebetween However, in embodiments, alone or in combination with a casing or coating material, a casing for encapsulating the article to be transported may include one or more features that reduce, or further reduce friction between the wellbore and the article. For instance, the article and/or casing may include one or more slip pads on an exterior surface thereof, may include one or more wheels, may be formed from a material having a low coefficient of friction, or may contain a low-friction coating material on an external surface thereof.

By way of example only if the distance into a town 5 was four km and the articles or packages were accelerated at only 1 G for two km and decelerated at 1 G for the remaining two km, the time taken for the pod to travel the four km length from start to finish would be 40 seconds.

In embodiments, one or more lateral or second wellbores (sometimes called sidetracks) can be drilled from the full-sized borehole, the pilot borehole, or a combination thereof. The lateral or second wellbores may therefore be connected to the full-sized borehole via one or more splits or branches in the full-sized borehole. These one or more sidetrack wellbores could be drilled according to any one or more of the embodiments as described above for the first wellbore, and could thus be used to provide a number of branches, splits, and/or junctions, so that the articles (or pods or packages containing articles) can be directed to multiple locations in an urban area from a location outside the urban area.

Once the wellbore has been drilled in the manner described, it can be used to deliver packages from a remote location into an urban area. Namely, due to the high degree of consistency in the wellbore shape and direction, the full-sized borehole may exhibit smooth walls, wall transitions, and diameter, leaving the full-sized borehole well suited for delivery of packages that would otherwise be caught on rough portions or transitions of a borehole wall. As mentioned above, the first location may include an access to the full-sized borehole for delivery of packages or articles into the wellbore. Similarly, the urban second location may include an access to the full-sized borehole for delivery of the packages or articles, or for returning packages or articles to the first location. In embodiments, for example, full-sized borehole disused herein may allow packages to be delivered in a manner like a pneumatic tube. As with pneumatic tubes in past and conventional applications, a package or pod that may or may not be contained or encapsulated in a casing (such as an exterior shell or the like, which may be a rigid or semi-rigid plastic, metal, or the like) to enclose an article to be delivered, may be easily transported through the pneumatic tube, such as by air pressure. However, it should be clear that other delivery processes, such as conveyors, draw lines, trolley type pushcarts, and the like, are contemplated.

In embodiments, the transit of the packages or articles (alone or encased in an external pods or casing) through the wellbore(s) can be monitored and tracked. For example, the packages and/or articles, or the casing containing such packages and/or articles, can be provided with a QR code, an RFID tag, a scanner code, or any other type of unique identifier. Such a code or tag can contain routing information, among other types of information, such as a particular location through a sidetrack wellbore. As the package, pod, or good travels through the wellbore system, the code or tag can be scanned or read, and the results of the scan or reading can be transmitted to a central computer system. The central computer system can be programmed to adjust one or more valves to control the flow of air and/or pressure to control the route of the good, package, or pod, such as by altering the flow of air just before the good, package or pod reaches a branch so that the good, package or pod travels through the desire wellbore branch. Alternatively, or in addition, the wellbore system may have one or more baffles or other gates that can be moved and controlled by the central computer system to adjust the route of a particular package, pod, or good so that it takes the desired branch when it arrives there. In some embodiments, the central computer system might be programmed to adjust the air flow and/or pressure to speed up or slow down the movement of one or more goods, packages, or pods, so that it (or they) arrive at the desired location within the urban area at a desired time or within a desired window of time.

In embodiments, the trajectory of the wellbore can be selected based on the goods to be transported and the axial and lateral forces to which they will be subjected as they are transported through the wellbore. For example, the goods (and/or their packaging) may be of a type that should not be subject to an axial or lateral force greater than one or more thresholds. In such cases, the acceleration and deceleration of the goods as they travel through the wellbore should be considered and may be used to determine the shape of the wellbore. Instead of a wellbore path that begins with a vertical drop, for example, the wellbore may instead begin with a more gentle downward path. Similarly, curves in the wellbore can be drilled to be more gradual (e.g., with a greater radius of curvature) to minimize the forces that the goods and their packaging encounter. The speed of the goods as they are transported may also be considered in planning the wellbore trajectory, such as by including a downward slope for the wellbore to take advantage of gravity to move the goods along the wellbore. Moreover, the foregoing considerations can be applied to all portions of the wellbore, including any and all sidetrack wellbores such as those described above. It is expected that the wellbore trajectory will be adapted to provide a pathway with an optimized geometry that balances the length of the route for the goods with the lateral and axial acceleration (and deceleration) forces experienced at each point along the path to protect the contents from excessive force. The permissible axial speeds will likely depend on factors such as the goods to be transported and/or the strength of their packaging. Nonetheless, in embodiments, the wellbore path may be planned to decrease friction (e.g. by including high-radius curves and smooth transitions, as well as a high degree of conformance to the planned trajectory to improve wall smoothness transitions), as the article may be contained in an external casing that protects the articles from damage during transit.

Nonetheless, as discussed above, in embodiments, it may be desired to have a low entry angle at the first access point, second access point, or both the first access point and second axis point. A low entry angle may decrease the drilling distance and may also improve package entry and receival. For instance, in embodiments, one or more of the access points may have an entry angle, measured between the drilling angle and the surface of less than or about 80 degrees, such as less than or about 70 degrees, less than or about 60 degrees, less than or about 50 degrees, less than or about 45 degrees, less than or about 40 degrees, less than or about 35 degrees, less than or about 30 degrees, less than or about 25 degrees or such as greater than or about 5 degrees, greater than or about 10 degrees, greater than or about 15 degrees, greater than or about 20 degrees, greater than or about 25 degrees, or any ranges or values therebetween.

In addition, the full-sized borehole may exhibit little to no high radius turns or curves. For instance, in embodiments, some or all of the curves or turns of the full-sized borehole, before or after casing, may have a radius of about 1 degree per 100 feet to about 10 degrees per 100 feet, such as less than or about 9 degrees per 100 feet, less than or about 8 degrees per 100 feet, less than or about 7 degrees per 100 feet, less than or about 6 degrees per 100 feet, less than or about 5 degrees per 100 feet, less than or about 4 degrees per 100 feet, less than or about 3 degrees per 100 feet, less than or about 2 degrees per 100 feet, or any ranges or values therebetween. In such a manner, the full-sized borehole may exhibit a high degree of smoothness, and may also eliminate the likelihood of any package becoming trapped in curve or turn of the full-sized borehole.

Figure 10:
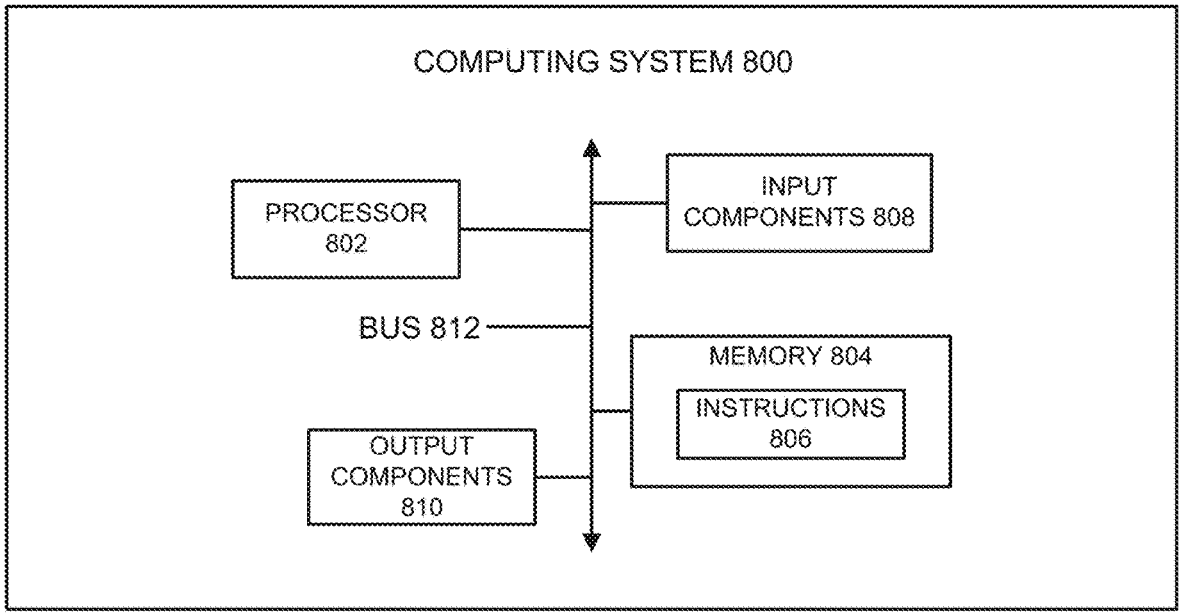
FIG. 10 illustrates an exemplary compute system utilized according to embodiments herein.

FIG. 10 provides a schematic of a block diagram of an example of a computing device usable for implementing some embodiments of the present disclosure. The computing device 800 includes a processor 802 coupled to a memory 804 via a bus 812. The processor 802 can include one processing device or multiple processing devices. Examples of the processor 802 include a Field-Programmable Gate Array (FPGA), an application-specific integrated circuit (ASIC), a microprocessor, or any combination of these. The processor 802 can execute instructions 806 stored in the memory 804 to perform operations. In some examples, the instructions 806 can include processor-specific instructions generated by a compiler or an interpreter from code written in any suitable computer-programming language, such as C, C++, C#, Python, or Java.

The memory 804 can include one memory device or multiple memory devices. The memory 804 may be non-volatile and include any type of memory device that retains stored information when powered off. Examples of the memory 804 can include electrically erasable and programmable read-only memory (EEPROM), flash memory, or any other type of non-volatile memory. At least some of the memory 804 includes a non-transitory computer-readable medium from which the processor 802 can read instructions 806. A computer-readable medium can include electronic, optical, magnetic, or other storage devices capable of providing the processor 802 with computer-readable instructions or other program code. Computer-readable storage media includes, but is not limited to, RAM, ROM, erasable programmable ROM ("EPROM"), electrically-erasable programmable ROM ("EEPROM"), flash memory or other solid-state memory technology, compact disc ROM ("CD-ROM"), or other optical storage, magnetic cassettes, magnetic tape, magnetic disk storage or other magnetic storage devices, or any other medium that can be used to store the desired information in a non-transitory fashion.

The computing device 800 may operate in a networked environment using logical connections to remote computing devices and computer systems through a network, such as the local area network. The computing device 800 may include functionality for providing network connectivity through a NIC, such as a gigabit Ethernet adapter. The NIC is capable of connecting the computing device 800 to other computing devices over the network. It should be appreciated that multiple NICs may be present in the computing device 800, connecting the computer to other types of networks and remote computer systems.

The computing device 800 may also include other output (I/O) components. The output components 810 can include a visual display, an audio display, or any combination of these. Examples of a visual display can include a liquid crystal display (LCD), a light-emitting diode (LED) display, and a touch-screen display. An example of an audio display can include an audible indicator.

The non-transitory computer-readable storage medium may store processor executable instructions that, when executed by the processor, cause the processor to perform operations including determining at least one property of the device and controlling a function of the device based on the at least one property. For example, the at least one property can close one or more actuators, determining a drill offset, determining a target delivery speed or time, as well as other functions made clear herein.

In some embodiments, the device may receive instructions from a mobile application executing on a mobile or hand-held device or other network-connected or wireless device. For example, the mobile device can include a phone, a hand-held computer, tablet, or other device that is mobile. In some embodiments, the device may receive instructions from a second computing device, for example, from a computer station within a control hub discussed above.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilize the invention in various embodiments and with various modifications as are suited to the particular use contemplated. Therefore, further modifications or improvements may be incorporated without departing from the scope of the invention herein intended.

When a group of substituents is disclosed herein, it is understood that all individual members of those groups and all subgroups and classes that can be formed using the substituents are disclosed separately. When a Markush group or other grouping is used herein, all individual members of the group and all combinations and sub-combinations possible of the group are intended to be individually included in the disclosure. As used herein, "and/or" means that one, all, or any combination of items in a list separated by "and/or" are included in the list; for example "1, 2 and/or 3" is equivalent to "1, 2, 3, 1 and 2, 1 and 3, 2 and 3, or 1, 2, and 3".

Every formulation or combination of components described or exemplified can be used to practice the invention, unless otherwise stated. Specific names of materials are intended to be exemplary, as it is known that one of ordinary skill in the art can name the same material differently. It will be appreciated that methods, device elements, starting materials, and synthetic methods other than those specifically exemplified can be employed in the practice of the invention without resort to undue experimentation. All art-known functional equivalents, of any such methods, device elements, starting materials, and synthetic methods are intended to be included in this invention. Whenever a range is given in the specification, for example, a temperature range, a time range, or a composition range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition, in a description of a method, or in a description of elements of a device, is understood to encompass those compositions, methods, or devices consisting essentially of and consisting of the recited components or elements, optionally in addition to other components or elements. The invention illustratively described herein suitably may be practiced in the absence of any element, elements, limitation, or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Although specific embodiments have been described, various modifications, alterations, alternative constructions, and equivalents are also encompassed within the scope of the disclosure. Embodiments are not restricted to operation within certain specific data processing environments but are free to operate within a plurality of data processing environments. Additionally, although embodiments have been described using a particular series of transactions and steps, it should be apparent to those skilled in the art that the scope of the present disclosure is not limited to the described series of transactions and steps. Various features and aspects of the above-described embodiments may be used individually or jointly.

Further, while embodiments have been described using a particular combination of hardware and software, it should be recognized that other combinations of hardware and software are also within the scope of the present disclosure. Embodiments may be implemented only in hardware, or only in software, or using combinations thereof. The various processes described herein can be implemented on the same processor or different processors in any combination. Accordingly, where components or modules are described as being configured to perform certain operations, such configuration can be accomplished, e.g., by designing electronic circuits to perform the operation, by programming programmable electronic circuits (such as microprocessors) to perform the operation, or any combination thereof. Processes can communicate using a variety of techniques, including but not limited to conventional techniques for inter process communication, and different pairs of processes may use different techniques, or the same pair of processes may use different techniques at different times.

The specification and drawings are, accordingly, to be regarded in an illustrative rather than a restrictive sense. It will, however, be evident that additions, subtractions, deletions, and other modifications and changes may be made thereunto without departing from the broader spirit and scope as set forth in the claims. Thus, although specific disclosure embodiments have been described, these are not intended to be limiting. Various modifications and equivalents are within the scope of the following claims.

What is claimed is:

1. A method of drilling a wellbore for transportation of goods, the method comprising:

drilling a first wellbore with a first diameter;

determining an offset of the first wellbore from a desired position along at least a portion of a length of the first wellbore; and drilling a second wellbore with a second diameter correcting the determined offset, wherein drilling the second wellbore comprises a drill bit comprising a bullnose and one or more blades, the one or more blades comprising a blade central shaft and the bullnose comprising a bullnose shaft having a bullnose central axis, wherein the bullnose shaft extends from the bullnose into the blade central shaft and is freely movable by one or more actuators within the blade central shaft, and wherein the second diameter is greater than the first diameter.

2. The method according to claim 1, further comprising:

casing an interior facing portion of an external surface of the second wellbore.

3. The method according to claim 2, further comprising:

coating an interior surface of the casing with a low friction material.

4. The method according to claim 3, wherein the first wellbore and the second wellbore extend from a first location to a second location, wherein the second location is within an urban area.

5. The method according to claim 4, wherein the second wellbore extends from the first location to a plurality of locations, wherein at least one of the plurality of locations is within the urban area.

6. The method according to claim 5, further comprising drilling a third wellbore extending from a position along the second wellbore to a third location, wherein the third location is remote from both the first location and the second location.

7. The method according to claim 1, further comprising:

surveying at least a portion of the first wellbore;

responsive to the survey of the first wellbore, determining a plurality of offset values from a desired trajectory of the first wellbore, wherein each of the plurality of offset values corresponds to one of a plurality of depths and/or distances along the first wellbore; and responsive to the plurality of offset values, activating the one or more actuators to control an amount by which the drill bit is offset from the central axis of the bullnose during drilling of the second wellbore.

8. The method according to claim 1, wherein the first wellbore comprises a trajectory adapted to provide a pathway with an optimized geometry balancing the length of the wellbore with the lateral and axial acceleration forces experienced at each point along the pathway.

9. The method according to claim 8, wherein the second wellbore comprises a trajectory adapted to provide a pathway with an optimized geometry balancing the length of the wellbore with the lateral and axial acceleration forces experienced at each point along the path.

10. A method of drilling a wellbore for transportation of goods, the method comprising:

drilling a pilot wellbore;

determining an offset of the pilot wellbore from a desired position along at least a portion of a length of the pilot wellbore; and drilling a full-sized wellbore correcting the determined offset, wherein:

drilling the full-sized wellbore comprises a drill bit comprising a bullnose and one or more blades, the one or more blades comprising a blade central shaft and the bullnose comprising a bullnose shaft having a bullnose central axis, wherein the bullnose shaft extends from the bullnose into the blade central shaft and is freely movable by one or more actuators within the blade central shaft, the full-sized wellbore comprises a tortuosity index that varies from a planned wellbore tortuosity index by less than or about 20%;

the full-sized wellbore extends from a first location to a second location;

the first location is remote from the second location; and the second location is within an urban area.

11. The method according to claim 10, further comprising:

casing an interior surface of the full-sized wellbore.

12. The method according to claim 11, further comprising:

coating an interior surface of the casing with a material to reduce friction.

13. The method according to claim 10, further comprising:

surveying at least a portion of the pilot wellbore;

responsive to the survey of the pilot wellbore, determining a plurality of offset values from a desired trajectory of the pilot wellbore, wherein each of the plurality of offset values corresponds to one of a plurality of depths and/or distances along the pilot wellbore; and responsive to the plurality of offset values, adjusting a drill bit parameter during drilling of the full-sized wellbore.

14. The method according to claim 10, further comprising:

selecting a trajectory of at least one of the pilot wellbore or the full-sized wellbore at least partially based on one or more goods to be transported therethrough.

15. The method according to claim 10, further comprising:

defining a first above ground access point to the full-sized wellbore at the first location; and defining a second above ground access point to the full-sized wellbore at the second location.

16. The method according to claim 15, wherein:

the first above ground access point is configured to provide access to the full-sized wellbore for providing one or more goods thereto; and the second above ground access point is configured to provide access to the full-sized wellbore for receiving the one or more goods therefrom.

17. The method according to claim 16, wherein:

the second above ground access point is further configured to provide access to the full-sized wellbore for returning one or more received goods.

18. The method according to claim 15, wherein:

at least one of the first above ground access points or the second above ground access points comprises an entry angle measured between a drilling angle and a surface of less than or about 80 degrees.

19. The method according to claim 10, wherein:

curves of the full-sized wellbore comprise a radius of between 1 degree per 100 feet and 10 degrees per 100 feet.

20. The method according to claim 10, wherein:

the pilot wellbore comprises a diameter of between 1 inch and 24 inches; and the full-sized wellbore comprises a diameter of between 8 inches and 120 inches.

* * * * *